United States Patent [19]

Ettinger et al.

[11] Patent Number: 5,049,891

[45] Date of Patent: Sep. 17, 1991

[54] RADOME-ANTENNA INSTALLATION WITH ROTATING EQUIPMENT RACK

[75] Inventors: John J. Ettinger, Bayshore; Eric S. Wimberger, Farmingdale; John DeMartino, Bethpage, all of N.Y.

[73] Assignee: Grumman Aerospace Corporation, Bethpage, N.Y.

[21] Appl. No.: 484,389

[22] Filed: Feb. 23, 1990

[51] Int. Cl.[5] ..... H01Q 1/280; H01Q 1/420

[52] U.S. Cl. ..... 343/705; 343/872

[58] Field of Search ..... 343/705, 757, 766, 872, 343/765, 882, 887, 708; 244/118.1

[56] References Cited

U.S. PATENT DOCUMENTS

| | | | |
|---|---|---|---|
| 2,980,909 | 4/1961 | Clanton, Jr. et al. | 343/705 |
| 3,026,516 | 3/1962 | Davis | 343/705 |
| 3,045,236 | 7/1972 | Colman et al. | 343/705 |
| 3,896,446 | 7/1975 | Kondoh et al. | 343/705 |
| 3,984,837 | 10/1976 | Tatnall | 343/705 |
| 4,380,012 | 4/1983 | Bevan et al. | 343/705 |
| 4,593,288 | 6/1986 | Fitzpatrick | 343/705 |
| 4,746,082 | 5/1988 | Syms et al. | 244/137.4 |
| 4,797,680 | 1/1989 | Smethers, Jr. | 343/705 |

FOREIGN PATENT DOCUMENTS

| | | | |
|---|---|---|---|
| 1492173 | 11/1977 | United Kingdom | 343/705 |

*Primary Examiner*—Rolf Hille
*Assistant Examiner*—Peter Toby Brown
*Attorney, Agent, or Firm*—Scully, Scott, Murphy & Presser

[57] ABSTRACT

High-powered antenna installations employable in rotatable electrical systems for the transmission and reception of electromagnetic energy and, more particularly, an integral radome-antenna structure which is mounted for rotation on the exterior of an aircraft. The rotatable radome-antenna structure which is adapted to be mounted on aircraft, or possible on other suitable support installations, will prevent excessive electrical power losses encountered in present day structures, particularly inasmuch as the essential components, such as the antenna signal receiving and transmitting devices, power generating structure and air turbines, including cooling conduits for circulating coolant to and from the various components are mounted on the rotatable structure of the system, such as an equipment rack and shelf structure, so as to be rotated in conjunction with the radome-antenna structure.

23 Claims, 5 Drawing Sheets

RADOME-ANTENNA INSTALLATION WITH ROTATING EQUIPMENT RACK

BACKGROUND OF THE INVENTION

1. Field of the Invention

The invention relates to high-powered antenna installations employable in rotatable electrical systems for the transmission and reception of electromagnetic energy and, more particularly, relates to an integral radome-antenna structure which is mounted for rotation on the exterior of an aircraft.

The utilization of integral radome-antenna structures, and particularly such types of structures which are rotatably mounted on aircraft and employed as so-called airborne early warning systems (AEW) is well-known in the technology, and has successfully found widespread applications in conjunction with military surveillance aircraft,, especially aircraft adapted to be launched from naval carriers. In various instances, as currently utilized in military aircraft, such radome-antenna structures are mounted positions so as to be superimposed above the fuselage of the aircraft, although conceivably also being suspendable from below the fuselage, and incorporate a depending shaft structure, generally hollow in nature, extending downwardly from the radome into the fuselage of the aircraft, and wherein the shaft is operatively connected to a suitable drive arrangement for simultaneously rotating the shaft about the longitudinal axis thereof and the radome-antenna structure at specified speeds of rotation. Suitable couplings and slip ring assemblies may be provided in order to connect the antenna array contained in the radome to suitable stationary sources of electrical energy while, concurrently, enabling the pick-up of signals received by the antenna array and to transmit the signals to stationary signal processing component and/or display consoles which are located in the cabin of the aircraft. Moreover, a suitable cooling fluid may also be transmitted to the antenna components contained in the radome through the intermediary of the hollow shaft mounting and supporting the radome-antenna installation for rotation. However, the components for supplying electrical energy to the antenna array and picking up the signals derived therefrom, in addition to the heat exchange structure for circulation of a cooling fluid for the rotating components of the radome-antenna structure are normally stationary components mounted in the interior of the aircraft. Although this is generally adequate and satisfactory for utilization with currently employed low or moderately powered airborne radome-antenna surveillance systems, which generally employ complex rotary couplings to transfer electrical power and/or radio frequency signals between the revolving radome and the stationary equipment contained in the aircraft, the development of much more sophisticated and higher-powered surveillance systems, particularly of the airborne radome type, has rendered the use of such rotary couplings for the transfer of electrical power and signals between rotating and stationary components to be extremely inefficient in view of significant and frequently untenable electrical losses ordinarily encountered with the rotary couplings which are currently designed in such radome installations. High-powered systems of this type which are presently being contemplated for installation in airborne rotatable radome-antenna structures may necessitate the generating and distribution of electrical power at a level which is a multiple of that in presently utilized systems, and may conceivably incorporate an excess of fifty or even more separately controllable electrical circuits within the rotatable radome. Such electrical circuits must be able to be accommodated in the rotary coupling, and hence signifies a greater potential for encountering electrical losses and signal distortions in the radio frequency signals which are received from the antenna array contained in the radome.

In order to reduce the potential for considerable electrical losses and signal distortion in such high-powered systems which are contemplated in utilization with the rotatable radome-antenna structure pursuant to the invention, there is accordingly proposed the use of a rotating equipment rack which is arranged interiorly of the aircraft fuselage, such as within the cabin space of the aircraft, and which is rigidly fastened to and concurrently rotatable with the rotating shaft supporting the radome-antenna installation for rotation, so as to constitute essentially a unitary assembly therewith. This enables that practically all of the surveillance system equipment be contained in the radome; in essence, the antenna array and associated electrical and signal receiving components, and the rotating equipment rack supporting surveillance system components mounted on the rotatable shaft may be permanently or hard-wired together so as to impart a greater degree of efficiency and resultingly reduced power losses and signal distortion to the system. In conjunction therewith, the electrical power which is to be generated for the surveillance system components in the radome and on the equipment rack is supplied through the intermediary of electrical generators, which are driven or powered by an air turbine motor fixedly fastened to and suspended from a shelf mounted on the lower end portion of the rotatable shaft at a location below the floor of the crew cabin of the aircraft; and which rotates with the shaft.

The novel and unique connection of the electrical components which are mounted on the equipment rack which is fastened to and rotatable in unison with the shaft supporting the radome-antenna structure, enables the restriction to or positioning of all of the high-power RF and other analog signal generating and processing components to the inventive rotating equipment rack and radome, with the electrical power generation, analog beam forming, signal processing and analog/digital conversion taking place in the components supported on the hard-wired rotating assembly supported on the equipment rack interiorly of the aircraft.

Moreover, the air turbine motor which is mounted on the shelf fastened to the lower end portion of the rotatable shaft below the cabin floor of the aircraft, and which is powered by aircraft bleed air, is adapted to drive and power one or more electrical power generators, which are also supported from the shelf, for supplying electrical power to the surveillance system components contained in the radome or mounted on the equipment rack. Hereby, a multi-function rotary coupling is mounted on the bottom end portion of the hollow rotatable shaft, and is supported from the aircraft fuselage structure, so as to enable aircraft bleed air to be supplied to the air turbine motor which is suspended from the rotatable shelf, while enabling the supply therethrough into suitable conduits in the shaft for the circulation of a cold liquid coolant to all equipment in the radome and on the rotating equipment rack requiring positive or forced cooling thereof, and enabling receipt of hot liquid coolant return flow for discharge from the rotating installation for subsequent transfer to a stationary internal heat exchanger, the latter of which may be mounted at a suitable location in the aircraft, such as below the cabin space thereof in attachment to the fuselage.

2. Discussion of the Prior Art

Although various rotatable radome-antenna structures which are mounted on aircraft are currently in widespread application, particularly radomes supported on or from military surveillance radar aircraft, none of these disclose the mounting of the major electrical components and equipment on the rotating structure of the system, so as to inhibit or, in any event, considerably reduce the unacceptable levels of power losses or extent of signal distorting which may be encountered with regard to contemplated high-powered airborne radome surveillance systems.

Colman et al., U.S. Pat. No. 3,045,236, discloses a rotatable radome-antenna assembly which is mounted on an aircraft, and in which the assembly is supported on a rotatable hollow shaft extending downwardly through the aircraft fuselage. The lower end of the shaft includes a coupling for connection to a cooling unit and to a source of power for the electronic system components contained in the radome; whereas the upper portion of the hollow shaft within the fuselage incorporates a drive motor geared to the periphery of the shaft for imparting a predetermined rotational movement to the radome-antenna assembly. Although this type of structural and operational system would appear to be adequate for the relatively low electrical power requirements of currently employed rotating radomes, the high level of power losses and signal distortion encountered through the use of such structure for high-powered airborne surveillance systems as contemplated by the present invention would be unacceptable in the technology.

Davis, U.S. Pat. No. 3,026,516, discloses a rotatable radome for use on aircraft, wherein the rotatable radome is mounted on a heavy pylon which is fastened to the upper surface structure of the aircraft fuselage. Herein, there is also no disclosure of the various electronic and signal processing components and drive arrangements including the cooling conduits for the system being mounted so as to be rotatable in conjunction with the radome-antenna structure, thus potentially resulting in considerable energy losses when intended to be employed in connection with a high-powered surveillance system necessitating the installation of a greater complexity and quantity of sophisticated electronic and mechanical devices.

Clanton, Jr. et al., U.S. Pat. No. 2,980,909, disclose a radome-antenna installation which is mounted for rotation on a pylon fastened to the empennage section of an aircraft. In essence, this would be subject to the same limitations and drawbacks as in the construction of Davis U.S. Pat. No. 3,026,516. Basically, the structure disclosed in this patent would not be conducive towards affording a reduction in losses of electrical power and signal distortion to a level which would be acceptable in the higher-powered systems contemplated by the present invention for sophisticated and advanced military surveillance and early warning aircraft of this type.

SUMMARY OF THE INVENTION

Accordingly, it is an object of the present invention to provide for a novel and highly sophisticated rotatable radome-antenna structure which is adapted to be mounted on aircraft, or possible on other suitable support installations, which will prevent excessive electrical power losses encountered in present day structures, particularly inasmuch as the essential components, such as the antenna signal receiving and transmitting devices, power generating structure and air turbines, including cooling conduits for circulating coolant to and from the various components are mounted on the rotatable structure of the system, such as an equipment rack and shelf structure, so as to be rotated in conjunction with the radome-antenna structure. This, in essence, will extensively reduce if not completely inhibit any potentially significant power losses and signal distortions which are normally encountered in the interfacing between the rotating and stationary signal processing and electrical components, while concurrently facilitating a simple rotary coupling connection for the supply of cooling fluid to the antenna components and other constituents contained in the rotating system.

Accordingly, it is a primary object of the present invention to provide a rotatable integral radome-antenna structure which is subject to the least possible electrical power losses and signal distortions during operation thereof when employed in a higher-powered electrical surveillance system.

Another object of the present invention is to provide a rotatable radome-antenna installation of the type described which is adapted to be mounted in a simple manner on an aircraft, and in which the major electrical and signal processing components and power-generating elements are mounted on equipment rack and shelf installations of the rotatable structure of the surveillance system so as to be rotatable in cooperation with the movement of the radome-antenna installation.

BRIEF DESCRIPTION OF THE DRAWINGS

The foregoing and other objects of the invention may now be more readily ascertained from the following detailed description of an exemplary embodiment of a radome surveillance system pursuant to the invention, taken in conjunction with the accompanying drawings; in which.

DETAILED DESCRIPTION

Figure 1:
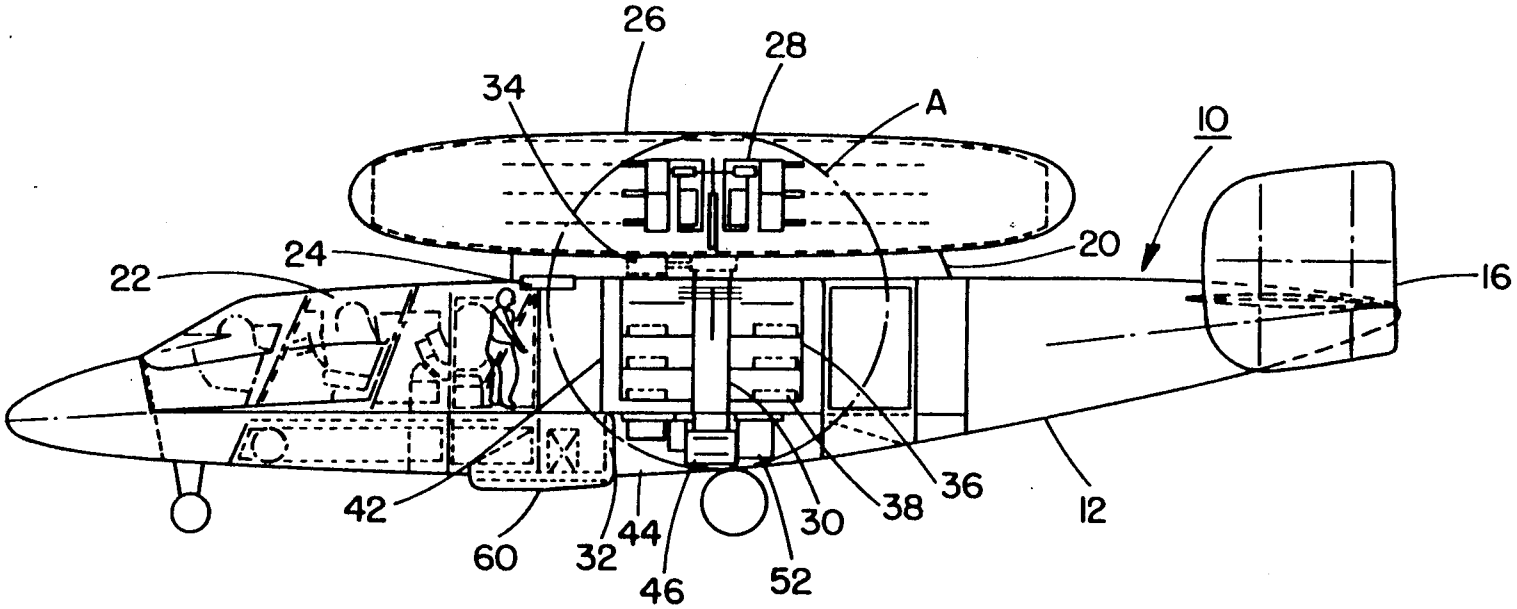
FIG. 1 illustrates a side elevational view, in longitudinal section, of an aircraft mounting the radome-antenna installation pursuant to the invention.
Figure 2:
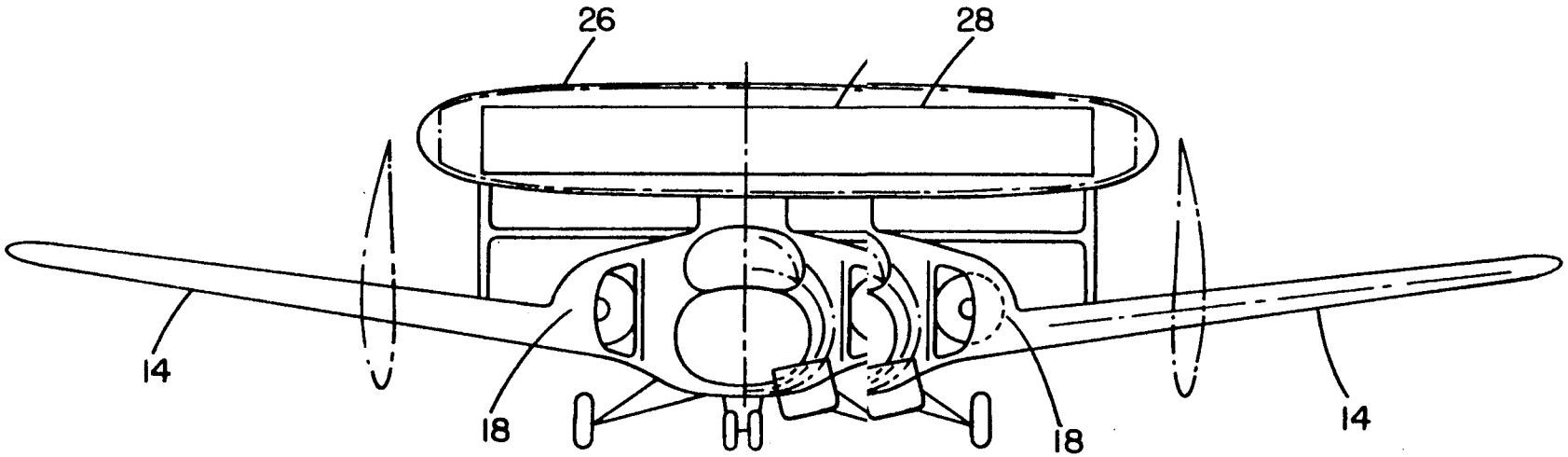
FIG. 2 illustrates a front view of the aircraft, with the radome being shown in transverse cross-section.
Figure 3:
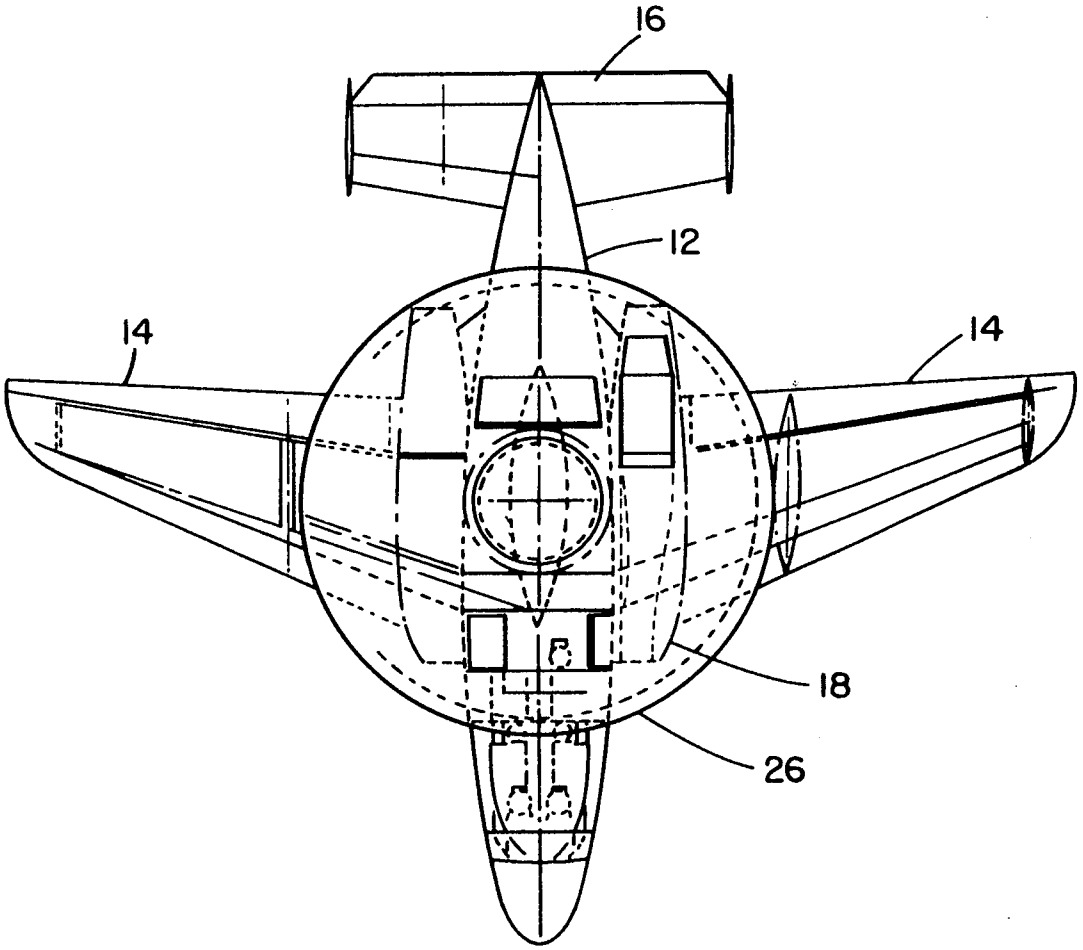
FIG. 3 illustrates a top plan view of the aircraft of FIG. 1, with the radome shown in substantially a phantom representation.

Referring now in more specific particularity to the drawings, and especially FIGS. 1 to 3, the airplane 10 which is disclosed therein possesses a fuselage 12, wings 14 (which may be foldable), an empennage 16, and engine nacelles 18 which are mounted on the wings and house aircraft engines, such as turbojets, turbofans or the like.

Figure 4:
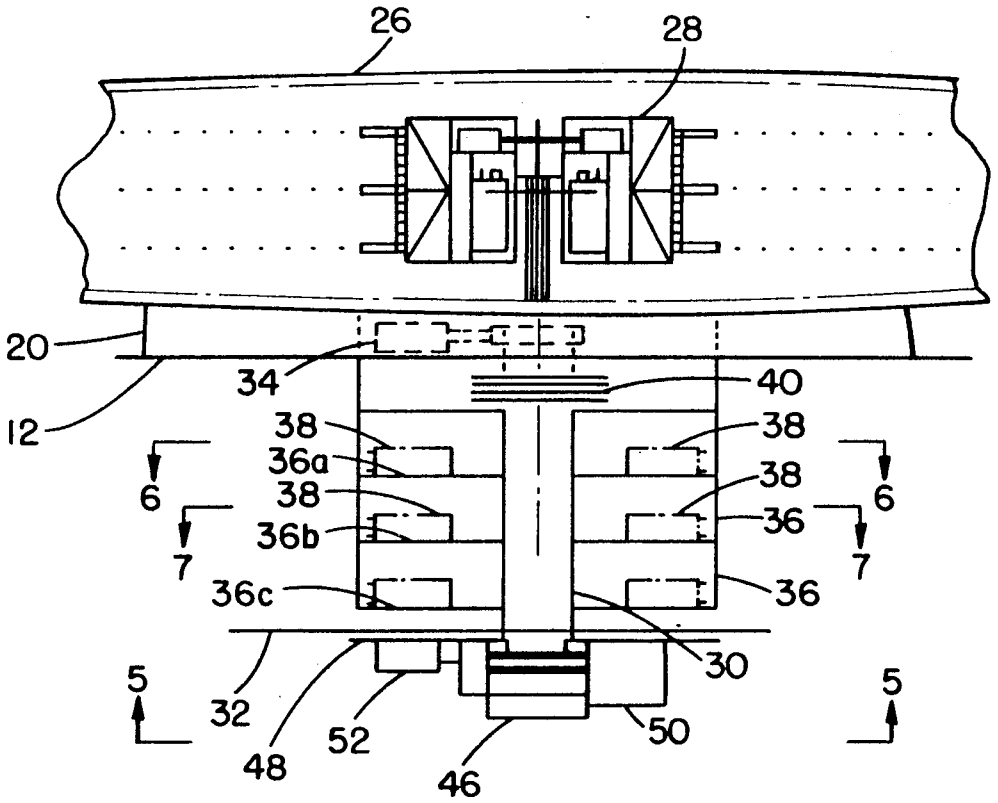
FIG. 4 illustrates a fragmentary sectional view of the radome and support structure therefore, as shown in the encircled portion A in FIG. 1.

As shown in FIG. 1, and in further detail in FIG. 4, a pylon 20 which has a generally streamlined configuration in order to reduce any aerodynamic drag during flight of the aircraft projects upwardly from the fuselage 12. The interior of the pylon 20 is accessible from a crew cabin 22 of the aircraft 10 through the intermediary of a suitable hatch 24 formed in the fuselage, for purposes as described hereinbelow.

A radome 26, the shape and size of which is dependent upon the type of aircraft on which it is mounted as well as the power of the surveillance system, as is the size and characteristics of an antenna array 28 located within the radome 26, is mounted above the pylon 20 for rotation about a vertical axis. Pursuant to a preferred embodiment of the radome 26, the latter is generally circular or disc-shaped in plan view, incorporating a slightly convex curved upper and lower surface and a sharp, thin or essentially rounded circumferential edge extending about the juncture of the upper and lower surfaces. The radome may be entirely constituted of, or incorporate window portions or segments of a material which is essentially transparent to radio frequency or radar energy, as is well known in the radar technology and does not require to be elucidated in connection with the present invention.

A shaft 30, which is essentially of hollow tubular construction, extends downwardly from its juncture with the lower portion of the radome 26, essentially vertically concentrically about the axis of rotation for the radome 26, through the upper surface of the fuselage 12 of the aircraft 10, and terminates beneath the floor 32 of the crew cabin 22. Mounted within the confines of the pylon 20, as shown in greater detail in FIG. 4 of the drawings, is a drive system 34 for imparting rotation to the radome 26 in conjunction with the antenna array 28 which is located therein, and to the vertically depending hollow shaft 30 which is rigidly fastened to the radome 26.

Within the interior or cabin space of the aircraft fuselage 12, the shaft 30 has an equipment rack 36 mounted thereon so as to be rotatable in conjunction therewith. The equipment rack 36 has fixedly supported thereon a plurality of electronic components 38 of various types, which constitute elements of the airborne early warning surveillance system equipment, and which were heretofore stationarily arranged in the aircraft or radar installations. These components 38 may include, but are not limited to, various modules relating to the transmission and/or processing of high-powered RF and other analog signals, with the electric power generation, analog beam forming and analog/digital signal conversion being undertaken in the components of the surveillance system which are fixedly supported on the rotating assembly of the rack 36 having an operative relationship with the radar antenna components contained in the radome 26, and with which they are "hardwired" together. Suitable digital transfer slip rings 40 are mounted on the shaft 30 and are in electrical connection or interface, in a manner well known in the art, with various stationary components of the electronic surveillance system which are arranged within the confines of the aircraft; for instance, various computers, control consoles, displays and information processing units.

The various electronic components 38 which are fixedly supported on the rotatable equipment rack 36 are generally arranged on a plurality of disc-like horizontal support platforms **38*a*, 38*b* and 38*c*, and may also be enclosed by a circumferentially extending wall structure 36*d* so as to limit access to the components. The entire equipment rack 36 and components 38 contained thereon may have the crew compartment of the aircraft shielded therefrom by means of a suitable radio frequency-shielded bulkhead 42**.

The lower end of the rotatable hollow shaft 30 projects through an opening in the floor 32 of the crew cabin so as to extend into a lower space 44 within the fuselage 12, and terminates at its lower end in a multifunctional rotary coupling 46 fastened to the shaft.

Arranged at a location above the coupling 46, but at a level below the floor 32, is a horizontal disc-shaped shelf 48 extending about, and fastened to the shaft 30 so as to be rotatable therewith. Suspended below and fastened to the bottom surface of the shelf is an air turbine motor 50 adapted to drive one or more electrical power generators 52 which are similarly mounted to the lower surface of the shelf 48.

Figure 5:
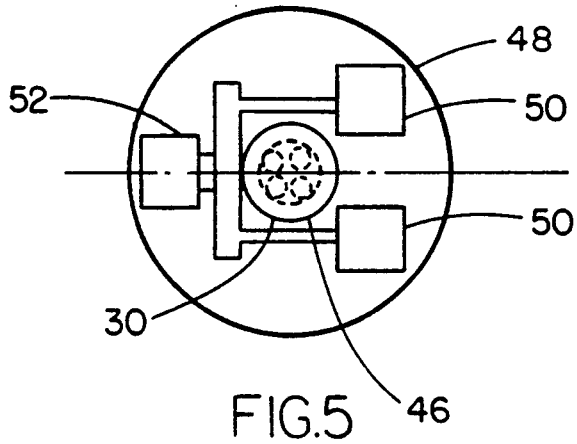
FIG. 5 illustrates a sectional view taken along line 5—5 in FIG. 4.
Figure 6:
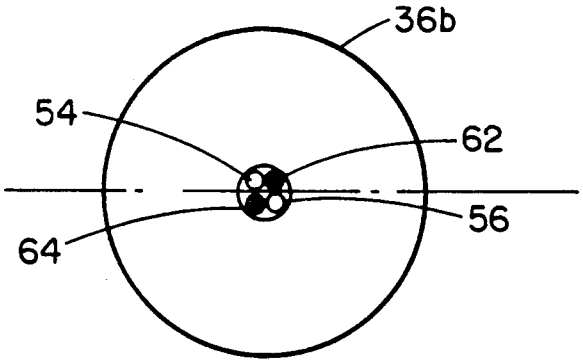
FIG. 6 illustrates a sectional view taken along line 6—6 in FIG. 4.
Figure 7:
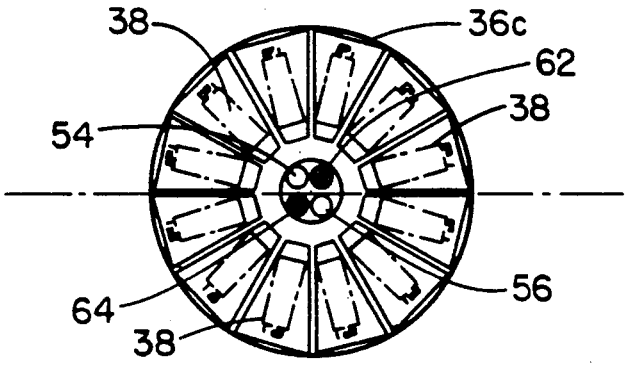
FIG. 7 illustrates a sectional view taken along line 7—7 in FIG. 4.

The inventive rotary coupling 46 at the lower end of the shaft 30 is designed to serve a plurality of functions in that it is adapted to receive and conduct aircraft bleed air to the air turbine motor 50 for the actuation thereof. Concurrently, as shown more specifically in FIGS. 5 through 7 of the drawings, extending upwardly through the rotary coupling 46 into the hollow interior of the shaft 30 are conduits 54 and 56 for, respectively, conveying a supply of a cool liquid coolant to the surveillance system equipment in the radome and on the rotating equipment rack and which require forced cooling during operation, and also for conveying the return flow of heated liquid coolant from the rotating installation out through the shaft 30 and the rotary coupling 46 for transfer to a stationary external heat exchanger 60 which, in this instance, is mounted in the bottom portion of the aircraft fuselage 12, and which cools and recirculates the liquid coolant.

In addition, the shaft 30 receives electrical power and radar system signal and control cables 62, 64 for transmitting electrical power from the electrical power generators 52 through the shaft 30 to the surveillance system components 38 which are mounted on the equipment rack 36 and between the components and the antenna installation 28 which is contained in the radome 26, and also for electrical communication with the slip rings 40 on the shaft 30 for connection to the stationary components in the aircraft.

For example, radar components 28 contained in the radome 26 may be, two UHF arrays with interleaved L-band arrays mounted back-to-back and spanning the interior diameter of the radome 26. In essence, each L-band array may consist of 660 elements configured in 66 columns with a transmitter/receiver module being provided for each column. The UHF arrays may be of a tripled-stack flaired notch design, one array with 24 columns and one array with 28 columns, and with the UHF array possessing respectively one such transmitter/receiver module for each column. A three-phase 400 Hz electrical power distribution harness may be connected to all equipment and adapted to receive power directly up the hollow shaft 30 from the electrical power generators 52 which are mounted to the rotatable shelf 48. Similarly, the cold liquid coolant leading to the radar equipment 28 contained in the radome 26 and the components 38 on the equipment rack 36, and the hot coolant discharge therefrom is transferred through the distribution piping referred to hereinabove as master piping in the center shaft 30 and eventually outwardly through the rotary coupling 46 so as to suitably connect with the heat exchanger 60.

Although the foregoing radar surveillance system has been described in connection with an airborne early warning radar system (AEW) which is mounted on an aircraft, it is readily conceivable that the rotatable radome and the other rotatably-mounted components disclosed herein may be constituents of a ground-based or geographically fixed radar installation.

Furthermore, as mentioned hereinbefore, the hatch 24 which is provided in the top of the fuselage 10 in the region of the crew cabin 22 enables access to the interior of the pylon 20 so as to allow for repairs to be implemented to the radome equipment when the rotation and functioning thereof is temporarily terminated while the aircraft is in flight.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed and as hereinafter claimed.

What is claimed is:

1. In an aircraft having a fuselage, a pylon projecting from the upper end of said fuselage, and being fixed attached thereto; a radar surveillance system including a generally disc-shaped radome rotatably mounted above said pylon and having the maximum diameter thereof oriented in a plane substantially in parallel with the longitudinal axis of said fuselage; antenna means fixedly secured within said radome; a shaft extending vertically through said fuselage and traversing said pylon, said radome being fastened tot he upper end of said shaft; means for imparting rotation to said shaft about the longitudinal axis of the shaft and concurrently to said radome and antenna means; rack means mounted on said shaft interiorly of said fuselage, said rack means being rotatably with said shaft; electronic surveillance system components operatively connected with said antenna means and including high-power RF and analog-to-digital conversion components being fixedly supported on said rack means for rotation therewith; electric power generating means being mounted on said shaft proximate the lower end thereof for supplying electrical power to said system components and said antenna means; and a generally disc-shaped shelf being mounted on said shaft proximate the lower end thereof and being rotatable with said shaft, said electric power generating means being fastened to the lower surface of said shelf.

2. A surveillance system as claimed in claim 1, wherein said electric power generating means comprising at least one electric power generating; and air turbine motor means being fastened to the lower surface of said shaft for driving said electric power generator.

3. A surveillance system as claimed in claim 2, wherein a rotary coupling is fastened to the lower end of said shaft, said rotary coupling conducting aircraft bleed air to said air turbine motor means.

4. A surveillance system as claimed in claim 3, wherein said shaft comprises a hollow tubular member; first conduit means extending from said rotary coupling upwardly within said shaft to said antenna means and the system components on said rack means for conducting a flow of cold liquid coolant therethrough from a stationary heat exchanger mounted in said aircraft; and second conduit means extending from said antenna means and said system components on said rack means for reconveying hot liquid coolant downwardly within said shaft and to said rotary coupling for return flow of said hot coolant to said heat exchanger.

5. A surveillance system as claimed in claim 4, wherein electrical power cables extend within said shaft interconnecting said electric power generating means with said antenna means in said radome and said system components on said rack means for supplying electrical power to said antenna means and system components.

6. A surveillance system as claimed in claim 4, wherein radar system signal and control cables extend within said shaft interconnecting said antenna means and said system components on said rack means; and digital slip rings being mounted on said shaft electrically interfacing with said signal and control cables for effecting digital data transfer to and from stationary signal processing and display means arranged in the fuselage of said aircraft.

7. A surveillance system as claimed in claim 1, wherein said rack means comprises a plurality of superimposed shelves spaced along the longitudinal axis of said shaft, said system components being fastened to the shelves of said rack means.

8. A surveillance system as claimed in claim 1, wherein said rack means includes an encompassing wall structure enclosing said system components.

9. A surveillance system as claimed in claim 1, wherein an RF-shielded bulkhead separates said rack means and the system components supported thereof from a crew cabin in said aircraft fuselage.

10. A surveillance system as claimed in claim 3, wherein the lower end portion of said shaft mounting the shelf supporting said air turbine motor means and electric power generating means, and the rotary coupling are located below the floor of a crew cabin in said aircraft fuselage.

11. A surveillance system as claimed in claim 2, wherein two said electric power generators are fastened to said shelf and are driven by said air turbine motor means.

12. A surveillance system as claimed in claim 1, wherein said means for rotating said shaft and said radome comprises a drive motor arranged within said pylon.

13. In a stationary radar installation, a radar surveillance system including a radome being rotatably mounted above said stationary installation; antenna means fixedly secured within said radome; a shaft extending vertically through said stationary installation, said radome being fastened to the upper end of said shaft; means for imparting rotation to said shaft about the longitudinal axis of the shaft and concurrently rotating said radome and antenna means; rack means mounted on said shaft interiorly of said stationary installation, said rack means being rotatable with said shaft; electronic surveillance system components being operatively connected with said antenna means and including high-power RF and analog-to-digital conversion components being fixedly supported on said rack means for rotation therewith; electric power generating means being mounted on said shaft proximate the lower end thereof for supplying electrical power to said system components and said antenna means; and a generally disc-shaped shelf being mounted on said shaft proximate the lower end thereof and being rotatable with said shaft, said electric power generating means being fastened to the lower surface of said shelf.

14. A surveillance system as claimed in claim 13, wherein said electric power generating means comprises at least one electric power generator and air turbine motor means being fastened to the lower surface of said shelf for driving said electric power generator.

15. A surveillance system as claimed in claim 14, wherein a rotary coupling is fastened to the lower end of said shaft, said rotary coupling conducting pressurized air to said air turbine motor means.

16. A surveillance system as claimed in claim 15, wherein said shaft comprises a hollow tubular member; first conduit means extending from said rotary coupling upwardly within said shaft to said antenna means and the system components on said rack means for conducting a flow of cold liquid coolant therethrough from a stationary heat exchanger in said stationary installation; and second conduit means extending from said antenna means and said system components on said rack means for reconveying hot liquid coolant downwardly within said shaft and to said rotary coupling for return flow of said hot coolant to said heat exchanger.

17. A surveillance system as claimed in claim 16, wherein electric power cables extend within said shaft interconnecting said electric power generating means with said antenna means in said radome and said system components on said rack means for supplying electrical power to said antenna means and system components.

18. A surveillance system as claimed in claim 16, wherein radar system signal and control cables extend within said shaft interconnecting said antenna means and said system components on said rack means; and slip rings being mounted on said shaft electrically interfaced with said signal and control cables for effecting digital data transfer to and from stationary signal processing and display means in the stationary installation.

19. A surveillance system as claimed in claim 13, wherein said rack means comprises a plurality of superimposed shelves spaced along the axis of said shaft, said system components being fastened to the shelves of said rack means.

20. A surveillance system as claimed in claim 13, wherein said rack means includes an encompassing wall structure enclosing said system components.

21. A surveillance system as claimed in claim 13, wherein an RF-shielded bulkhead separates said rack means and the system components supported thereof from the surroundings about said system components.

22. A surveillance system as claimed in claim 14, wherein two said electric power generators are fastened to said shelf and are driven by said air turbine motor means.

23. A surveillance system as claimed in claim 13, wherein said means for rotating said shaft and said radome comprises a drive motor arranged within said radar installation.

* * * * *